United States Patent [19]

Reasinger et al.

[11] Patent Number: 5,041,071

[45] Date of Patent: Aug. 20, 1991

[54] PRECISE POSITIONING OF BLANK IN DIE

[75] Inventors: Jeffrey C. Reasinger, Hilliard; Gene C. Longbrake, Kenton, both of Ohio

[73] Assignee: Pressware International, Inc., Columbus, Ohio

[21] Appl. No.: 448,521

[22] Filed: Dec. 11, 1989

[51] Int. Cl.[5] ..... B31B 3/44; B31B 3/46

[52] U.S. Cl. ..... 493/167; 493/143; 493/417

[58] Field of Search ..... 493/143, 167, 174, 417

[56] References Cited

U.S. PATENT DOCUMENTS

| | | | |
|---|---|---|---|
| 2,474,944 | 7/1949 | Henry | 493/417 |
| 3,541,930 | 11/1970 | Goodrich | 493/167 |
| 4,581,005 | 4/1986 | Moen | 493/167 |
| 4,936,815 | 6/1990 | Kirkland et al. | 493/125 |

*Primary Examiner*—William E. Terrell

*Attorney, Agent, or Firm*—Frank H. Foster

[57] ABSTRACT

A paper tray forming machine with an improved blank centering device which consists of at least one finger which is moved upward and toward two passive stops. The finger may be shaped similarly to the blank's edge so that precise positioning occurs during the motion of the fingers.

3 Claims, 3 Drawing Sheets

PRECISE POSITIONING OF BLANK IN DIE

TECHNICAL FIELD

This invention relates to the field of paper tray manufacturing by compressing a flat sheet of paper into a three-dimensional tray.

BACKGROUND ART

In manufacturing paper trays, a roll of paper is cut into many smaller pieces of paper which are called blanks. The blanks are then fed into a machine which uses shaped dies to stamp them into a desired shape and size.

The formed trays typically have a flange around the outer peripheral rim which provides structural rigidity and a mounting place for a lid. It is desirable to have a uniform flange on the tray not only to enhance its appearance, but also so that specific rigidity and mounting characteristics may be anticipated. In addition, a uniform flange enhances the ability of automated equipment to handle the tray with a minimum of difficulty.

Previously, a uniform flange was very difficult to attain. Because of the extreme deformations occurring to the paper, it was very difficult to predict the locations and amounts of deformations. Because of this problem, the manufacturers merely shaped the trays and then post-trimmed the flanges to a certain thickness, or discarded whichever trays did not meet their restrictions.

Recently the concern about the cost of materials and manufacturing has played an important part in deciding how to manufacture trays. By shaping and then trimming excess paper, a significant amount of waste is created. Additionally, because of the need to trim the tray, another manufacturing step is necessary.

Computer aided design machines have helped the manufacturing industry by allowing manufacturers to design a shape before making a working model of it and the dies used to shape it. With these computers, manufacturers can predict deformations and design a blank which, after being shaped, needs no trimming. This is contingent upon the correct alignment of the blank between the dies.

Upon researching the shape of the blank which would require no post trimming, it was discovered that the optimum blank would have rounded edges on nearly all sides. The disadvantage to having rounded edges is that it is very difficult to correctly align the blank by any conventional method.

Previously, the post-trimmed blanks were merely gravity fed onto a die and aligned with passive guide plates on each side of the die. The straight edged blank slid into position, was stamped into shape, and then trimmed in a subsequent operation.

The round edged blanks, however, tend to twist out of position when using the conventional passive guide plate arrangement. This stems from the fact that the round edged blanks do not contact the straight edged guide plates at enough points to be restrained from twisting. Because the blanks twist in the die, they have uneven flanges on their outer edges after stamping.

An additional disadvantage of having passive guides which have constant contact with the blank during sliding alignment is that usually the guides are hot due to transfer heat from the heated female die. This allows any plastic coating on the paper board to melt and stick to the heated guide plate as the blank attempts to slide into position. This sticking defeats the effect of gravity which is relied upon to align the paper board in the correct position Thus, the need arises for a device for positively positioning a round edged or otherwise oddly shaped paper blank on a die, requires no post trimming of the blank and does not allow enough contact to melt and stick to guides.

BRIEF DISCLOSURE OF INVENTION

The invention is directed to a paper tray forming machine. The machine, having two passive stops oriented in a generally perpendicular position relative to a blank supporting surface, is used for forming a three-dimensional tray out of a flat sheet of paper. The invention is an improved blank centering apparatus comprising at least one finger that has a component of motion towards the two passive stops. This finger positively positions the blank on the blank supporting surface, between the stops and the finger.

Figure 1:
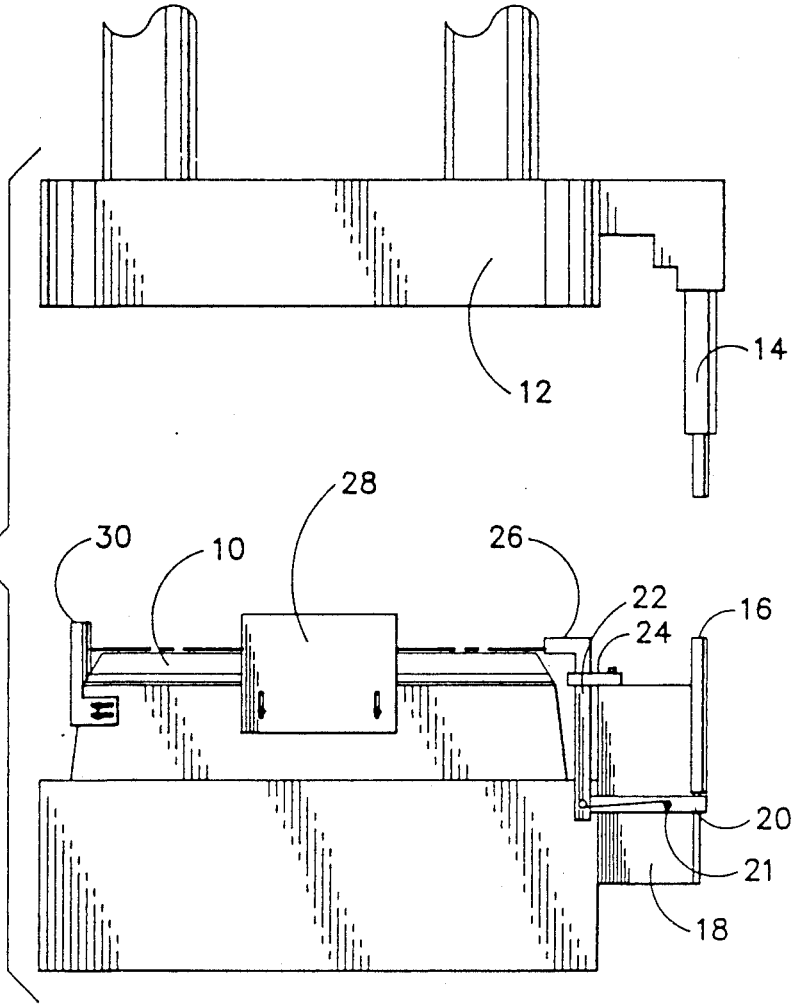
FIG. 1 shows a side view of an embodiment of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

The side view of the preferred embodiment of the machine is shown in FIG. 1. A flat tray blank is formed into a tray by being pressed between heated dies. FIG. 1 shows a lower die 10 which matingly receives an upper die 12 which descends down upon the lower die 10 after the blank is positioned on the top surface of the lower die 10. Attached to the upper die 12 is a downwardly extending actuating arm 14. The actuating arm 14 is spring biased by a spring, such as a gas spring, which exerts a sufficient force to actuate the positioning mechanism subsequently described.

Figure 2:
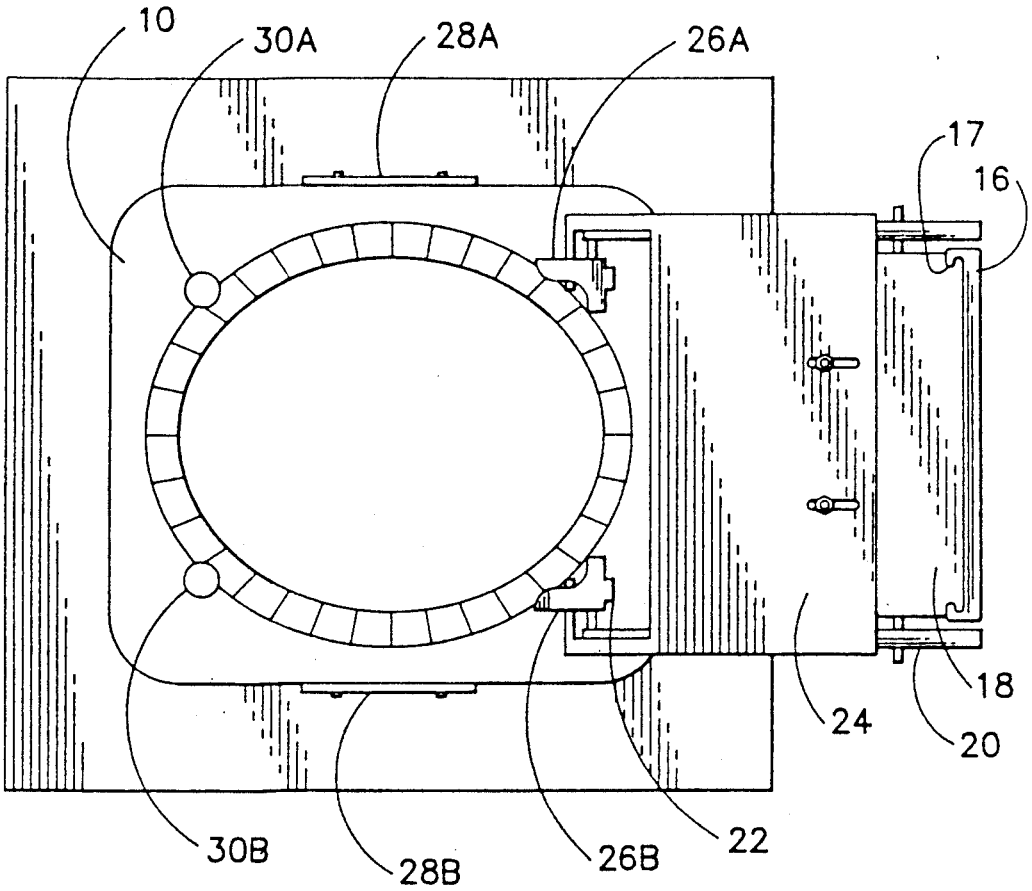
FIG. 2 shows a top view of the lower section of the embodiment of FIG. 1.
Figure 3:
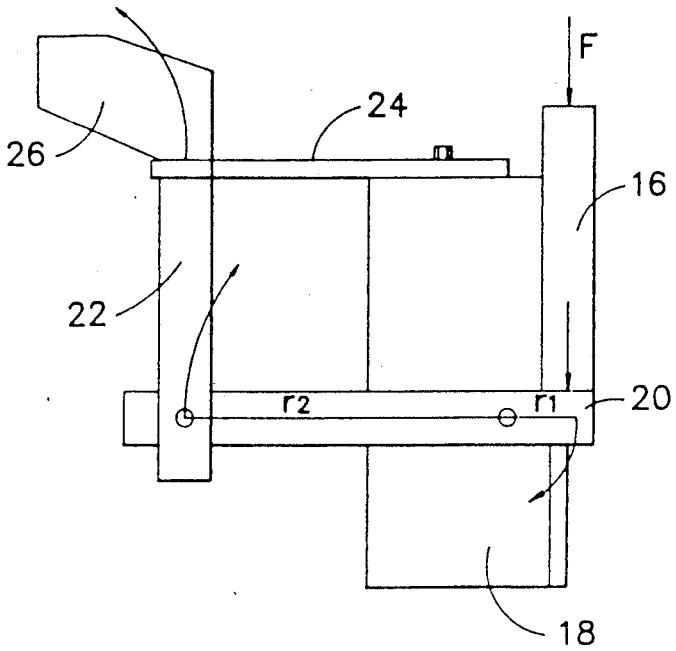
FIG. 3 shows the finger mechanism of FIG. 1.

Referring to FIGS. 1–3, a support body 18 is attached to an end of the lower die 10. The support body 18 has vertical, outwardly opening grooves 17 formed on two opposing outer sides. A vertically reciprocatable plunging body 16 has inwardly extending ridges which slide in the grooves 17 to facilitate the slidable mounting of plunging body 16. A rocker arm 20 is pivotally attached to the support body 18 beneath the plunging body 16 by the pivot axle 21. A finger support bar 22 is attached at the end of the rocker arm 20 opposite the plunging body 16. The finger support bar 22 is hingedly secured to the rocker arm 20 and extends upwardly through conforming openings in a guide plate 24. Fingers 26 are formed at the upper end of the support bar 22 and extend laterally toward the die 10.

Side guides 28A and 28B are attached to the sides of the lower die 10. On the die 10 at the opposite end from the support body 18 are upstanding passive stops 30A and 30B. The passive stops 30A and 30B, the side guides 28A and 28B, and the guide plate 24 are all mounted to their respective supports by adjustable connections which allow release and repositioning with subsequent reattachment.

During operation, the upper die 12 is lowered onto the tray blank, which has conventionally been fed on to the lower die 10, to press it against the lower die 10 by gas actuating cylinders or some other type of prime mover. As the upper die 12 descends down to the lower die 10, the actuating arm 14 comes into contact with the plunging body 16. As this occurs the actuating arm 14 exerts a force on the plunging body 16. This force causes the plunging body 16 to travel downward, exerting a force on the rocker arm 20. The gas will also be pushed further into the gas chamber. The downward force on the rocker arm 20 causes the rocker arm 20 to pivot about its pivot axle 21 and lift its opposite end upwardly following an arcuate path. This opposite end is hingedly mounted to the finger support bar 22, whose lower extremity therefore follows the arcuate path of the rocker arm. As the finger support bar 22 follows the upward and sideways arcuate path of the rocker arm 20, the upper extremity of the finger support bar 22 follows an upward and sideways motion, but in the sideways direction opposite the lower extremity.

The finger support bar 22 has free vertical motion, but upon any sideways motion, the guide plate 24 presents a fulcrum about which the finger support bar 22 pivots. Each finger 26 extends upward and in the opposite direction from the rocker arm 20 so as to force the blank against the passive stops 30A and 30B for proper positioning.

Figure 4:
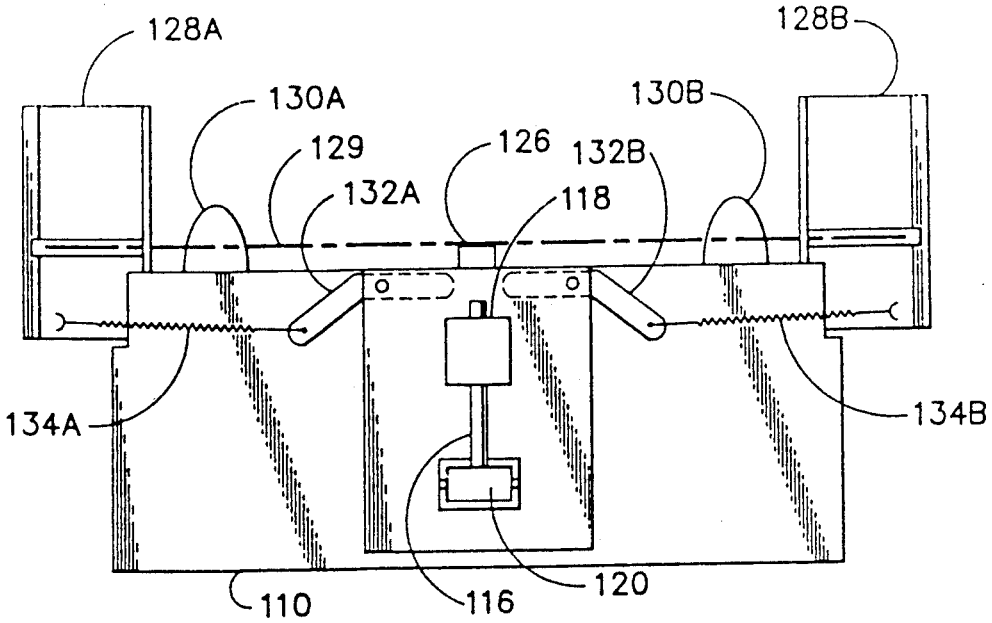
FIG. 4 shows a second embodiment of the present invention.
Figure 5:
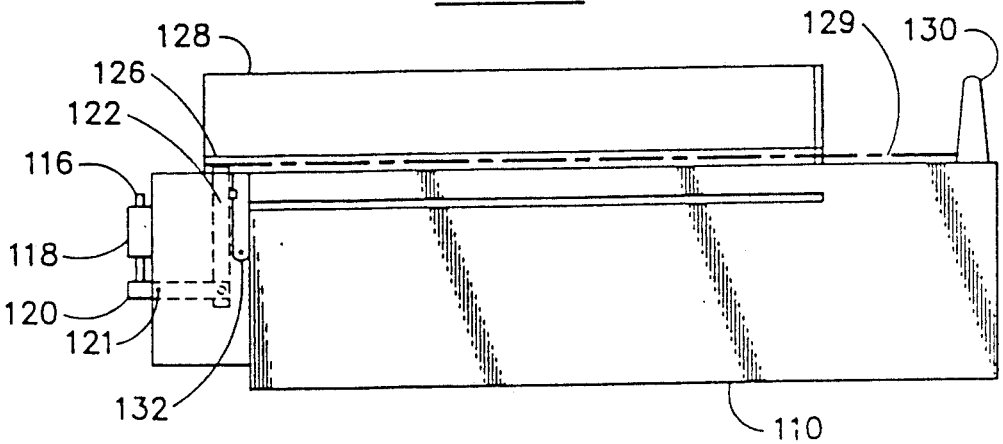
FIG. 5 shows a side view of the second embodiment of the present invention.
Figure 6:
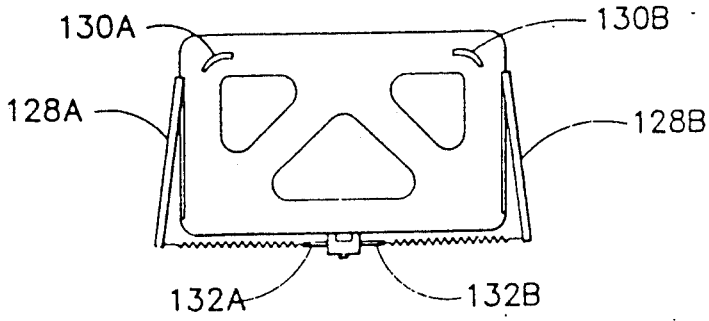
FIG. 6 shows a top view of the second embodiment of the present invention.

FIGS. 4, 5, and 6 show the alternative embodiment of the present invention utilizing a similar mechanism for aligning the blank, but with additional features. Attached to the lower die 110 is a support body 118. A plunging body 116 extends vertically, slidably through the support body 118 and its lower end contacts a rocker arm 120. The rocker arm 120 is pivotally mounted to the support body 118 by pivot axle 121 and is pivotally attached at its opposite end to a finger support bar 122. The finger support bar 122 extends slidably upward out of the support body 118 and its upper end forms a finger 126.

The operation of the mechanism is similar to the first embodiment of the present invention in that the upper die, like the one illustrated in FIG. 1, is forced down onto the lower die 110 causing an actuating arm attached to the upper die as in FIGS. 1–3, to force the plunging body 116 downward causing the finger 126 to follow an upward and sideways path and forcing the blank against a passive stop 130 in a manner similar to that in FIGS. 1–3.

The second embodiment utilizes active side guides 128A and 128B. These side guides 128A and 128B are hingedly attached to the lower die 110, so that they may move sidewardly to push and center the blank 129 above the lower die 110.

There are two angled draw arms 132A and 132B pivotally mounted near their midsections to the support body 118. These draw arms 132A and 132B are located on both sides of the finger support bar 122 and both contact the finger support bar 122 at generally the same place. At the point where the draw arms 132A and 132B contact the finger support bar 122, the draw arms 132A and 132B are generally horizontal, while their opposite ends, just beyond their pivot points, angle downward approximately 45 degrees from the horizontal so that each of the draw arms 132A and 132B forms a bell crank. At the end of each draw arm 132A and 132B there are attached springs 134A and 134B which are attached at their opposite ends to the side guide 128A and 128B.

After the blank 129 is deposited onto the lower die 110 and as the upper die descends downward onto the lower die 110, the actuation of the plunging body 116 causes the finger 126 to follow its usual arc-like trajectory pushing the blank 129 toward the passive stops 130A and 130B, such that the blank 129 is pushed into registration with the lower die 110. The finger support bar 122 moves upward and the draw arms 132A and 132B are forced upward at the finger support bar end and inward at the spring end toward the support body 118. As the draw arms 132A and 132B are drawn in toward the support body 118, the side guides 128A and 128B are drawn inward toward the center of the lower die 110 by the attached springs 134A and 134B.

The advantage to having active fingers which are shaped to fit the contour of the blank, such as those shown in FIG. 2, is that the blank may be positioned precisely resulting in even thickness of flanges. Additionally, an advantage to having the active finger 126 with the option of the side guides 128A and 128B as in the second embodiment, is that a blank with rounded sides which would normally pivot relative to a straight, passive side guide is now forced into position longitudinally and laterally by similarly shaped positioners. A third advantage to active positioning devices is that the blank 129, which may be covered with some type of meltable material, such as plastic, only comes into contact with the hot positioning devices when it needs only small amounts of alignment. The advantage then is that, as the blank 129 slides onto the lower die 110, it does not come into sliding contact with any of the hot guides which could cause the material to melt and stick to that guide, causing misalignment.

While certain preferred embodiments of the present invention have been disclosed in detail, it is to be understood that various modifications may be adopted without departing from the spirit of the invention or scope of the following claims.

We claim:

1. In a paper tray forming machine including an upper movable die means and a mating lower die means for forming flat paper sheet blanks into three dimensional trays and including adjustably positioned passive stop means oriented generally perpendicularly to said lower die means, an improved blank centering apparatus comprising:

(a) at least one finger having a component of motion toward the passive stops for positively positioning a blank, which is above the lower die means, between the stop means and the finger;

(b) an actuating arm attached to and moving downwardly with the upper die means; and (c) a finger actuating means mounted to the lower die means for moving the finger and comprising:

(i) a plunging body positioned to be engaged by the actuating arm upon downward movement of the upper die means and be driven downwardly by the actuating arm;

(ii) a rocker arm which pivots about a transverse axis and is positioned to be engaged at one end by the plunging body and driven downwardly by the plunging body causing the opposite end of the rocker arm to follow an arcuate path of motion;

(iii) a finger support bar having a lower extremity hingedly engaging and following the arcuate motion of said opposite end of the rocker arm; and (iv) a guide plate having an opening through which the finger support bar slidably extends for permitting the finger support bar to pivot about the opening of the guide plate while following the arcuate motion of the rocker arm, said finger being adjustably attached to an upper extremity of the finger support bar permitting said finger to move upward and toward the passive stop means.

2. The machine according to claim 1 wherein the finger is shaped to matingly engage with the contour of the blank.

3. The machine according to claim 2 or 1 wherein there are two of said fingers.

* * * * *